US006382302B1

(12) United States Patent
Imwinkelried

(10) Patent No.: US 6,382,302 B1
(45) Date of Patent: May 7, 2002

(54) CASTING SYSTEM FOR THIXOFORMS

(75) Inventor: Thomas Imwinkelried, Flurlingen (CH)

(73) Assignee: Alusuisse Technology & Management Ltd., Rheinfall (CH)

( * ) Notice: Subject to any disclaimer, the term of this patent is extended or adjusted under 35 U.S.C. 154(b) by 0 days.

(21) Appl. No.: 09/720,703

(22) PCT Filed: Jul. 10, 1999

(86) PCT No.: PCT/EP99/04862

§ 371 Date: Dec. 29, 2000

§ 102(e) Date: Dec. 29, 2000

(87) PCT Pub. No.: WO00/06323

PCT Pub. Date: Feb. 10, 2000

(30) Foreign Application Priority Data

Jul. 30, 1998 (EP) ..... 98810732

(51) Int. Cl.[7] ..... B22D 17/10
(52) U.S. Cl. ..... 164/312; 164/113; 164/900
(58) Field of Search ..... 164/312, 113, 164/900

(56) References Cited

U.S. PATENT DOCUMENTS 5,730,201 A * 3/1998 Rollin et al. ..... 164/113

FOREIGN PATENT DOCUMENTS

| | | |
|---|---|---|
| DE | 40 15 174 | 11/1991 |
| DE | 196 06806 | 8/1997 |
| EP | 0 718 059 | 6/1996 |

OTHER PUBLICATIONS

Patent Abstracts of Japan, vol. 098, No. 011, Sep. 30, 1998 & JP 10 175054 (Nissan Motor Co Ltd.) Jun. 30, 1998.
Patent Abstracts of Japan, vol. 095, No. 006, Jul. 31, 1995 & JP 07 068363 (Leotec:KK) Mar. 14, 1995.

* cited by examiner

*Primary Examiner*—Nam Nguyen
*Assistant Examiner*—I.-H. Lin
(74) *Attorney, Agent, or Firm*—Bachman & LaPointe, P.C.

(57) ABSTRACT

Diecasting machine for production of mouldings from thixotropic metal billets, containing a sprue system which connects a cylindrical casting chamber cavity with a moulding cavity, where the sprue system has a cylindrical sprue cavity immediately adjacent to the casting chamber cavity and contains at least one sprue, and all sprues lead laterally away from the generated surface of the sprue cavity and each sprue has a concentric center line and at its end facing towards the moulding cavity has an inlet opening for introduction of the thixotropic metal alloy into the moulding cavity, and the sprue system is connected to the casting chamber cavity by a passage opening perpendicular in relation to a concentric longitudinal axis of the cylindrical casting chamber cavity, wherein each sprue has a circular or elliptical cross section with a substantially constant cross sectional area over its entire length.

14 Claims, 2 Drawing Sheets

2a
2 b
35
A
2R1
2b
35
30
C
d
17
m1
y
20
12
10
16
73
Rk1
25
19
l
18
X
26
Rk2
74
14
m2
21
A
2R2

B
2a
B
35
NE1
30
20
y
z
18
21

CASTING SYSTEM FOR THIXOFORMS

CROSS-REFERENCE TO RELATED APPLICATION

This application is a 371 of PCT/EP99/04862, filed on Jul. 10, 1999.

BACKGROUND OF THE INVENTION

1. Field of Invention

The present invention concerns a diecasting machine for production of mouldings from thixotropic metal billets, containing a sprue system which connects a cylindrical casting chamber cavity with a moulding cavity, where the sprue system has a cylindrical sprue cavity immediately adjacent to the casting chamber cavity and contains at least one sprue, and all sprues lead laterally away from the generated surface of the sprue cavity, and each sprue has a concentric center line and at its end facing towards the moulding cavity has an inlet opening for introduction of the thixotropic metal alloy into the moulding cavity, and the sprue system is connected to the casting chamber cavity by a passage perpendicular in relation to a concentric longitudinal axis of the cylindrical casting chamber cavity, and the inlet openings are arranged in relation to the passage opening such that the surface normals of the inlet openings do not coincide with the longitudinal axis of the cylindrical casting chamber cavity.

2. Background and Prior Art

Diecasting machines for production of mouldings from thixotropic metal billets are known in themselves. Such diecasting plants essentially contain a casting chamber to hold the diecasting alloy or thixotropic metal billet, a ram moving in the longitudinal direction in the casting chamber for applying pressure to the diecasting alloy or thixotropic metal billet, at the end of the casting chamber opposite the ram a casting chamber opening, and a sprue system comprising essentially a sprue to transfer the diecasting alloy or thixotropic alloy paste from the casting chamber opening into the moulding cavity.

EP-A 0 718 059 describes a horizontal diecasting machine for production of mouldings from a thixotropic alloy paste, where the diecasting machine has an oxide scraper which is located between a semi-cylindrical area of the casting chamber, suitable for insertion of a thixotropic metal billet, and the moulding cavity, and which serves to prevent oxide inclusions in the alloy structure of the moulding.

DE-OS 40 15 174 describes a diecasting machine with a two-part mould for casting of plastic or metal, where between the two mould halves is fitted a specially shaped casting holding device which can assume a changing passage cross section and in its closing position delimits a tapering cross section which is smaller than the predetermined cross section of the casting chamber opening.

The process for production of mouldings from thixotropic i.e. part solid/part liquid metal billets is known as thixoforming. The metal billets are all billets of a metal which can be transformed into a thixotropic state. In particular the metal billets can consist of aluminium, magnesium or zinc or alloys of these metals.

Thixoforming utilizes the thixotropic properties of part liquid and part solid metal alloys. The phrase "thixotropic behaviour of a metal alloy" means that a correspondingly prepared metal behaves as a solid when not under load, but under a thrust load its viscosity reduces to the extent that it behaves in a similar way to a metal melt. This requires heating of the alloy in the setting interval between the liquid and solid temperature. The temperature must be set such that for example a structure proportion of 20 to 80 w. % is melted but the rest remains in solid form.

In thixoforming, part solid/part liquid metals are processed into mouldings in a modified diecasting machine. The diecasting machines used for the thixoforming differ in relation to diecasting machines for diecasting metal melts for example by a longer casting chamber to hold the thixotropic metal billet and a larger ram stroke required as a result, and for example a mechanically reinforced design of the parts of the casting machine guiding the thixotropic metal alloy due to the higher pressure loading of these parts during thixoforming.

Thixoforming takes place for example with a horizontal diecasting machine. In this machine the casting chamber which holds the thixotropic metal billet lies horizontal. In thixoforming a thixotropic metal billet is inserted in such a horizontal casting chamber of a diecasting machine and, by application of pressure from a casting ram, is introduced at high speed and under high pressure into a casting mould usually consisting of steel, in particular hot worked steel, i.e. it is introduced or injected into the moulding cavity of the casting mould where the thixotropic metal alloy sets. The pressure applied to the thixotropic metal billet is typically 200 to 1500 bar and in particular between 500 and 1000 bar. The resulting flow speed of the thixotropic alloy paste is for example 0.2 to 3 m/s and in particular 0.3 to 2 m/s.

The casting structure forming during setting of the thixotropic metal alloy in the casting mould essentially determines the properties of the moulding. The structure formation is characterised by the phases such as mixed crystal and eutectic phases, the casting grains such as globulites and dendrites, segregations and structure faults such as porosity (gas pores, micropores) and contamination, for example oxides.

The metal billets used for thixoforming of part solid alloys have a process-induced fine grain which—if no grain coarsening occurs during pretreatment of the thixotropic metal billets i.e. during heating of the billets and their transport into the diecasting machine—recurs in the alloy structure of the mouldings. A fine grain generally improves the material properties, increases the homogeneity of the alloy structure and helps avoid structural defects in the moulding. Thixoforming of part solid alloys in comparison with diecasting of metal melts also has further substantial advantages. These include a significant energy saving and shorter production times as firstly the thixotropic metal billets, in comparison with diecasting of metal melts, need be heated to a lower temperature and thus for a shorter time before thixoforming, and secondly, in the casting mould they cool or return to a solid state more quickly, which contributes to a reduction in grain coarsening. The energy saving arises in particular because a majority of the melt heat and the entire superheating heat, i.e. the heat additionally supplied to the metal alloy to achieve a temperature increase above the melt point to ensure the liquid state of the metal alloy, and the energy for keeping the melt warm, are no longer required. A further advantage is also the better dimensional precision due to the lower shrinkage and production of mouldings close to the final dimensions, whereby the machining steps are reduced and alloy material saved. Also, the processing temperature is around 100° C. lower and reduces the temperature change stress on the individual components of the diecasting machine, which extends the tool life. The lower processing temperature in thixoforming than in diecasting of metal melts allows the processing of alloys with a low iron content, as no alloying of the tool from contact melting occurs. Thixoforming also allows a better mould filling with fewer air inclusions.

In diecasting machines which are known from the state of the art, a metal billet in the thixotropic state, usually a thixotropic aluminium billet, is inserted into a casting chamber (or more precisely into a casting chamber cavity inside the casting chamber) and by means of pressure application is pressed through a usually cylindrical constriction at one end of the casting chamber known as the passage opening. The thixotropic material is thus sheared. The sheared thixotropic material, starting from a sprue cavity lying next to the passage opening, is deflected into trapezoid sprues and reaches the moulding cavity of a mould. Normally the sprues are arranged at approximately right angles to the concentric center axis of the passage opening. The arrangement between the casting chamber and moulding cavity is referred to below as the sprue system. The sprue system is used to introduce the thixotropic alloy paste in the casting chamber into the moulding cavity of the casting mould.

The mechanical stress on the thixotropic alloy paste during its transfer from the casting chamber cavity to the moulding cavity causes a shear liquefaction of the thixotropic alloy i.e. the thixotropic alloy becomes more liquid as a result.

The following requirements are imposed on a sprue system for thixoforming:

a) Good filling behaviour: the sprue system must be filled as evenly as possible over its entire cross section. In the speed range of the thixotropic alloy used, no gas or oxide inclusions may occur.

b) Good flow behaviour: the flow must be as laminar as possible to avoid eddying and undesirable liquefaction of the thixotropic material.

c) Good shearing behaviour: the shear liquefaction must be as homogeneous as possible over the entire cross section and the shear liquefaction must be kept as low as possible.

d) Low heat loss: on its passage through the sprue system, the thixotropic material should lose as little thermal energy as possible.

e) Minimum volume of sprue system: the material remaining in the sprue system at the end of the thixoforming process is not used for the filling process of the moulding cavity. Therefore the sprue system should have a minimum volume to guarantee optimum output of thixotropic material into the moulding cavity.

f) Good addition behaviour: during setting of the moulding, the thixotropic material in the sprue system must remain cohesive and liquid so that firstly the pressure transfer from the casting ram to the moulding can be maintained and secondly the volume deficit on the moulding caused by setting-induced shrinkage can be compensated by the addition of thixotropic material.

g) Good pressure transfer: the sprue system should allow as low a pressure loss as possible between the casting chamber cavity and the moulding cavity.

Sprue systems which are known from the state of the art only fulfil these requirements in part. In particular, the known sprue systems have too great a volume so that the output of thixotropic material per moulding can be improved substantially. Too great a volume of the sprue system used, in particular reduces the economic efficiency of the process.

Another disadvantage of the known sprue systems concerns the speed-dependent filling behaviour. The filling behaviour of a sprue system can differ widely depending on the ram speed and starting condition of the thixotropic billet. Thus at high ram speeds for example undesirable air inclusions can occur in the thixotropic alloy paste of the sprue system. On very rapid mould filling during thixoforming, turbulent flow conditions can occur which can lead to gas inclusions (air, separating agent or lubricant) in the mould, whereby any desirable subsequent heat treatment, for example solution heat treatment of the moulding, is often rendered impossible. Gas inclusions close to the surface of the moulding can for example lead to undesirable blister formation during solution heat treatment due to the high gas pressure.

Another disadvantage of the known sprue system concerns the uneven flow behaviour. The flow established during thixoforming after filling the sprue system with thixotropic material is uneven in most cases. It has been found in particular that sudden direction changes and/or changing cross section ratios lead to local speed changes of the thixotropic material. It has also been found that with angular cross sections of the sprues only part of the available cross section is effectively used for guiding the thixotropic material.

In view of the disadvantages described above of the known sprue systems for diecasting machines for production of mouldings from thixotropic material, the inventors have faced the task of preparing a sprue system which avoids the said disadvantages and which fulfils optimally the requirements imposed for a sprue system of a diecasting machine for thixoforming.

SUMMARY OF THE INVENTION

According to the invention, this is solved in that each sprue has a circular or elliptical cross section with a substantially constant cross sectional area over its entire length, and immediately next to the sprue cavity has a manifold, where the part of the sprue between the manifold and the inlet opening describes a straight tubular channel section and the manifold is formed such that its center line has a constant bending radius, and a tangent to the center line continued to the passage opening with the same bending radius at the passage opening runs parallel to the longitudinal axis of the cylindrical casting chamber cavity, and a tangent to the center line at the end of the manifold facing towards the inlet opening coincides with the center line of the straight tubular channel section.

By the design of the sprue system according to the invention, direction changes and the associated shear liquefaction of the thixotropic alloy paste during transport from the passage opening to the inlet opening remain minimal. Each sprue preferably has a constant cross sectional area between the sprue cavity and the inlet opening. This keeps the flow speed of the thixotropic alloy as constant as possible and minimises the shear effect on the thixotropic alloy.

Also, preferably the sum of the cross sectional surfaces of the individual sprues substantially corresponds to the cross sectional area of the passage opening. The sum of the cross sectional areas of the individual sprues next to the sprue cavity, in a particularly preferred form, deviates by no more than ±10% from the cross sectional area of the passage opening.

In a further preferred embodiment of the sprue system, the sprue has at its end facing against the moulding cavity a chamfer area which ends in the corresponding inlet opening. Preferably, the sprues between the sprue cavity and the relevant chamfer area have a tubular channel section with a circular cross section and constant radius. The channel section between the sprue cavity and the chamfer area firstly concerns the manifold and secondly the straight channel section between the manifold and the chamfer area of each sprue. This circular cross section minimises the ratio of surface area to volume. Also, the circular cross section allows full utilisation of the available channel cross section.

Preferably, the inlet openings have an elliptical cross section. The inlet opening arises from the plane of section of the chamfer area of the sprue with the widening moulding produced in the moulding cavity. With a flat moulding wall, an elliptical inlet opening therefore arises. With curved moulding geometries normally more complex planes of section occur.

The chamfer area constitutes a channel-like transition area between the straight section of the sprue with circular cross section and the inlet opening. Preferably, the chamfer area along its center line has a cross section which gradually transforms from a circular to an ever flatter elliptical cross section, where this transitional area ends in an elliptical cross section corresponding to the inlet opening. Preferably, in the chamfer area the cross sectional area is kept substantially constant in size where changes of cross sectional area of up to 30% in size are included; in particular the cross section of the chamfer area along its center line can gradually expand or contract slightly.

In a further preferred embodiment the sprue system according to the invention has a catchment pocket for the surface oxide layer of the thixotropic metal billet. During pretreatment, storage and the heating process of the thixotropic metal billet, a metal oxide layer normally occurs. To avoid inclusion of such oxidic constituents in the alloy structure of the moulding, the oxidic generated surface of the thixotropic metal billet is removed usually before or in the casting chamber. Normally, an oxide layer remains on the face of the thixotropic billet. The catchment pocket proposed in the embodiment of the sprue system according to the invention thus allows the deposit of this surface oxide layer in a flow-mechanically dead zone at the end of the sprue cavity remote from the passage opening. The catchment pocket is for example formed by a cylindrical protuberance of the sprue cavity on the side remote from the passage opening.

The sprue system according to the invention is preferably used for horizontal diecasting machines.

Also, preferably the straight channel sections of the sprues run perpendicular to the longitudinal axis of the casting chamber cavity. The bending radius of the center line of the sprue manifold corresponds to the distance of the passage opening from a straight line containing the center line of the straight tubular channel section of the corresponding sprue.

According to the invention the bending radius of a center line in the manifold area is determined for example by the intersection point of the angle bisector between the longitudinal axis of the casting chamber cavity and the center line of the straight part section of the corresponding sprue with a plane through the passage opening, where the distance between this intersection and the center point of the passage opening gives the bending radius Rk.

The transition between the casting chamber cavity and sprue cavity can be sharp-edged or rounded. In a sharp-edged design, this transition is described by the passage opening. Preferably, however, a rounded transition is used. Here the passage opening is described by the point at which the cross section is at its smallest or where the cross section assumes a constant value i.e. transforms into a sprue cavity with constant cross section. In the rounded design form of the transition between the cylindrical casting chamber cavity and the passage opening therefore a transitional area is formed with a constantly reducing cross section. The creation of such a transitional area causes an even shear effect of the thixotropic alloy paste. This also avoids the breakaway of the thixotropic alloy flow from the wall of the passage opening as frequently occurs with sharp-edged transitions and high flow speeds.

Further advantageous designs of the sprue system according to the invention arise from the dependent claims.

The sprue system according to the invention is primarily suited for thixoforming of all metal alloys which can be transferred to a thixotropic state. Preferably, the sprue system according to the invention is used for thixoforming of aluminium, magnesium or zinc alloys. Particularly preferably, the sprue system according to the invention is suitable for thixoforming of aluminium diecasting alloys, in particular AlSi, AlSiMg, AlSiCu, AlMg, AlCuTi and AlCuZnMg alloys.

The sprue system of the invention has the following advantages over the state of the art:

a) Minimum sprue system volume:
By the use of round sprues, the total surface is kept as small as possible. Also, because of the optimum ratio of surface area to volume, the heat loss is minimal. Therefore less thixotropic material is required to compensate for the heat loss of the thixotropic alloy paste in the sprue system.

b) Good filling behaviour:
The filling behaviour of the sprue system is very good in the mould filling speed range—i.e. the flow speed of the thixotropic alloy—normally used for thixoforming, i.e. no air inclusions occur even at relatively high flow speeds.

c) Flow behaviour:
The flow behaviour with a sprue already filled with thixotropic alloy is excellent as the entire cross sectional surface of the sprue is utilised and no flow-mechanically dead zones occur. Also, the round channel cross section of the sprue allows the formation of a laminar flow for the entire speed range used for mould filling.

d) Adjustability of viscosity:
Due to the low shear liquefaction of the thixotropic alloy at the passage opening and the sprue, a high viscosity of the thixotropic alloy can be retained as far as the inlet opening. At the inlet opening the viscosity of the thixotropic alloy paste required for filling the moulding cavity can be set.

e) Minimum pressure loss and good addition behaviour:
The ram pressure is transferred extremely well by the curved inlet channels according to the invention i.e. the pressure loss in the sprues is minimal and because of the hydrostatic pressure, is determined in particular by the selected height of the corresponding inlet opening. The addition behaviour is also substantially determined by the height of the inlet openings due to the low pressure drop in the sprues.

DESIGN EXAMPLE

Diecasting machine with a horizontal casting chamber in which the transition from the casting chamber cavity to the sprue cavity is sharp-edged, and the sprue system has two sprues of the same dimensions each with one chamfer area.

The cross section of the sprue section between the sprue cavity and the chamfer area is circular and has a diameter of 2 R=25 mm. The bending radius of the manifold is 42.5 mm. The passage opening diameter is 35 mm. The sprue cavity is cylindrical and has a horizontal concentric longitudinal axis which also coincides with the concentric longitudinal axis of the casting chamber cavity. The sprue cavity has a diameter of 35 mm. The length of the sprue cavity is such that between the two manifolds a catchment pocket is formed for the surface oxides of the thixotropic billets, where the cross sectional dimensions of the catchment pocket correspond to those of the sprue cavity. The straight channel section of each sprue lies vertical and thus perpendicular to the concentric longitudinal axis of the casting chamber cavity, where the one sprue extends vertically downwards and the other sprue leads vertically upwards. The height of the start of the chamfer area, measured from the concentric longitudinal axis of the sprue cavity, amounts to 102.5 mm. The length of the chamfer area is 50 mm. The inlet openings lie in a horizontal plane and have an ellipsoid form with a main axis length a and a secondary axis length b. The shape of the chamfer area can be described in a Cartesian co-ordinate system in which the x axis lies parallel to the concentric longitudinal axis of the casting chamber cavity, the y axis parallel to a vertical, and the z axis also lies in a horizontal plane through the x axis such that:

$$x(y)=(b-R)\cdot y/c+R$$

and $$z(y)=(c\cdot R2)/(b\cdot y-R\cdot y+R\cdot c)$$

where R is the constant radius of the circular cross section sprue section between the sprue cavity and the chamfer area, b the length of the secondary axis of the inlet opening and c the length or height of the chamfer area. In this Cartesian co-ordinate system the main axis a of the inlet opening lies parallel to the z axis and the secondary axis b parallel to the x axis. The inlet openings thus have an ellipse shape with a secondary axis diameter of 2 b=6 mm and a main axis diameter of 2 a.

BRIEF DESCRIPTION OF THE DRAWINGS

Further advantages, features and details of the diecasting machines according to the invention arise from the embodiments shown in FIGS. 1 to 9 and from the description of the figures.

DETAILED DESCRIPTION OF THE INVENTION

FIGS. 1 to 9 concern for example views of a horizontal diecasting machine according to the invention i.e. a diecasting machine with horizontally arranged casting chamber.

Figures 1, 2, 3:
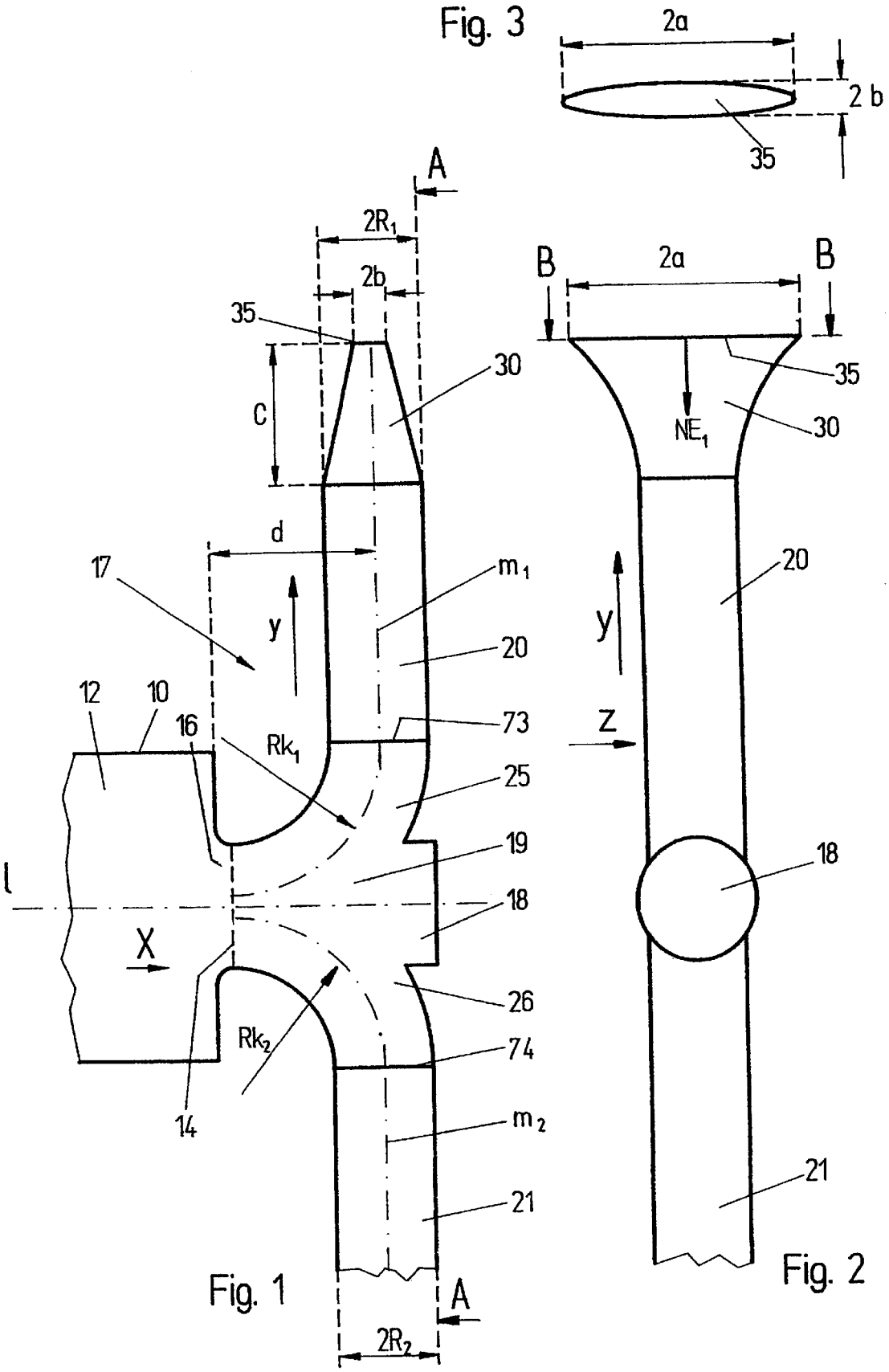
FIG. 1 shows diagrammatically a partial view of a longitudinal section running vertically through the concentric longitudinal axis of the casting chamber cavity of a diecasting machine according to the invention with two sprues.
FIG. 2 shows a top view along line A—A of the diecasting machine shown in longitudinal section in FIG. 1.
FIG. 3 shows a top view along line B—B of the diecasting machine shown in FIGS. 1 and 2.

FIG. 1 shows a partial view of a longitudinal section running vertically through the concentric longitudinal axis 1 of the casting chamber cavity 12 of a horizontal diecasting machine according to the invention for the production of mouldings from thixotropic metal billets, where this longitudinal section shows part of the horizontal casting chamber 10 and the sprue system 17.

The casting chamber 10 contains a cylindrical casting chamber cavity 12 which has a concentric longitudinal axis 1. The sprue system 17 connects the casting chamber cavity 12 with the moulding cavity (not shown). The sprue system 17 shown in FIG. 1 has two sprues, sprue 20 and sprue 21. Sprues 20 and 21 constitute tubular structures, the cavities of which each have a concentric center line $m_1$ and $m_2$. Sprues 20, 21 are connected with the casting chamber cavity 12 by means of a passage opening 14 common to the two sprues. The passage opening constitutes a rotationally symmetrical opening perpendicular to longitudinal axis 1 on the sprue-side end of the casting chamber 10.

Under pressure impacting on the thixotropic metal alloy in casting chamber 10, the thixotropic alloy paste is pressed in flow direction x through the passage opening 14 of the casting chamber 10 and reaches the moulding cavity of the casting mould (not shown) through sprues 20, 21.

The transition from the casting chamber cavity 12 to the passage opening 14 can be sharp-edged or rounded. In a sharp-edged transition the passage opening 14 is directly on the sprue-side end of casting chamber 10. The diecasting machine shown in FIG. 1 has a rounded transition between the casting chamber cavity 12 and the passage opening 14.

This gives a transition area 16 which tapers continuously in flow direction x.

The sprue system 17 has a circular cylindrical sprue cavity 19 immediately adjacent to the passage opening 14, where the cross sectional area of the sprue cavity 19 shown in FIG. 1 corresponds to the cross sectional area of the passage opening 14, and a concentric longitudinal axis of the sprue cavity 19 coincides with the longitudinal axis 1 of the casting chamber cavity 12. The sprues 20, 21—viewed in flow direction x—all lead laterally away from the generated surface of the sprue cavity 19.

Sprues 20, 21 have a circular or elliptical cross section where the cross sectional area of the sprues 21, 22 remains constant over its entire length i.e. between sprue cavity 19 and inlet opening 35. The sprues 20, 21 have, immediately adjacent to the sprue cavity 19, a manifold 25, 26 i.e. a curved tubular part. The part of each sprue 20, 21 between the manifold 25, 26 and inlet opening 35 describes a straight tubular channel section.

As the sprue system 17 according to the invention concerns only arrangements in which the surface normals $NE_1$ of the inlet openings 35 do not coincide with the longitudinal axis 1 of the casting chamber cavity 12, each center line $m_1$, $m_2$ describes a curve, where according to the invention the curved part lies at the start of the sprue 20, 21 i.e. next to the sprue cavity 19. The curved part of the center line $m_1$, $m_2$ has a constant bending radius $Rk_1$, $Rk_2$. The part of the sprue 20, 21 comprising the curved part of the center line $m_1$, $m_2$ is the manifold 25, 26. Manifold 25, 26 is designed such that a tangent to the center line $m_1$, $m_2$, continued to the passage opening 14 with the same bending radius $Rk_1$, $Rk_2$, at the manifold start located at the passage opening 14, runs parallel to the longitudinal axis 1 of the cylindrical casting chamber cavity 12.

The bending radii $Rk_1$, $Rk_2$ of center lines $m_1$, $m_2$ in manifolds 25, 26 are selected such that they correspond to the distance d of the passage opening 14 from the center line $m_1$, $m_2$ of the straight channel section of the relevant sprue 20, 21.

In each case a straight section of sprue 20, 21 connects to the moulding cavity-side end 73, 74 of the manifold 25, 26 so that the center lines $m_1$, $m_2$ of each sprue 20, 21, between the moulding cavity-side end of manifold 73, 74 and the inlet opening 35, 36, describe a straight line. In FIG. 1 the straight sections of the sprues 20, 21 stand perpendicular to the concentric longitudinal axis 1 of the casting chamber cavity 12. Consequently, the center lines $m_1$, $m_2$ of the straight sections of the sprues 20, 21 lie perpendicular to longitudinal axis 1.

The manifolds 25, 26 are also structured such that a tangent to the curved center line $m_1$, $m_2$ at the manifold end 73, 74 directed towards the inlet opening 35 coincides with the center lines $m_1$, $m_2$ of the straight channel section of the corresponding sprue 20, 21.

Sprues 20 and 21 each have at their end facing against the moulding cavity a chamfer area which ends in the corresponding inlet opening 35, where in FIG. 1 only the chamfer area 30 of the sprue 20 is shown. The transition from the chamfer area 30 to the moulding cavity takes place through the inlet opening 35 which lies perpendicular to the center line $m_1$ of the straight section of the sprue 20. Therefore the surface normals $NE_1$ of the inlet opening 35 leading through the center point of the inlet opening 35 coincide with the center line $m_1$ of the straight channel section of the corresponding sprue 20.

The sprues 20, 21 between the sprue cavity 19 and chamfer area 30, 31 are described by a tubular channel section with circular cross section and constant internal diameter 2 $R_1$, 2 $R_2$. Radii $R_1$, $R_2$ are selected such that the sum of the cross sectional areas of the two tubular channel sections with circular cross section of the sprues 20, 21 corresponds to the cross sectional area of the passage opening 14 i.e. $\pi \cdot R_1^2 + \pi \cdot R_2^2 = \pi \cdot R_D^2$, where $R_D$ is the radius of the circular passage opening 14. Consequently the sprues 20, 21 continued theoretically with the same bending radius to the passage opening 14, lie within the passage 14 so there is an overlapping of the sprues 20, 21 with the passage opening 14.

The length of the sprue cavity 19 is formed such that the sprue cavity 19 contains a catchment pocket 18 lying between the manifolds 25, 26 to receive the surface oxides of the thixotropic metal billet. Thus, the sprue cavity 19 firstly contains the manifolds 25, 26 continued theoretically from the generated surface of the sprue cavity 19 to the passage opening, and secondly the catchment pocket 18.

The inlet opening 35 shown in FIG. 1 has an elliptical form where the secondary axis of the ellipse lies parallel to the x axis in a horizontal plane parallel to the x-z plane, i.e. the secondary axis lies horizontal and in a vertical plane which contains the longitudinal axis 1 of the casting chamber cavity 12. FIG. 1 shows the inlet opening 35 through the secondary axis of length 2 b.

The chamfer area 30 shown in FIG. 1 concerns a transitional area of length c of the sprue 20 in which the straight section of the sprue 20 with circular cross section and constant radius $R_1$ transforms into the elliptical cross sectional shape of the inlet opening 35. Consequently, the chamfer area 30 in FIG. 1, i.e. in a longitudinal section running vertically through the concentric longitudinal axis 1 of the casting chamber cavity 12, has a trapezoid shape where the trapezium is formed with equal sides and two parallel sides have length 2 $R_1$ and 2 b and the parallel sides are arranged at a distance c.

FIG. 2 shows a top view along line A—A of the diecasting machine shown in longitudinal section in FIG. 1. In particular, it shows the circular contour of the catchment pocket 18, the sprues 20, 21 leading perpendicularly away from this and the chamfer area 30 of the sprue 20. The chamfer area 30 describes a continuously expanding area of sprue 20, the cross sectional dimensions of which in this view—starting from the straight channel section of the sprue 20 with circular cross section—transform continuously into the elliptical cross section of the inlet opening 35. In the view shown in FIG. 2, the inlet opening has a maximum expansion of size 2 a, where a is the main axis of the ellipse of the inlet opening 35. The expansion of the chamfer area 30 shown in FIG. 2 in the direction of the inlet opening 35 is formed such that the cross sectional dimensions of the chamfer area 30 remain constant along the center line $m_1$.

FIG. 3 shows a top view of the diecasting machine shown in FIGS. 1 and 2 along line B—B of FIG. 2. The ellipse shown in FIG. 3 thus describes a top view of the inlet opening 35. The inlet opening 35 lies in a horizontal plane parallel to longitudinal axis 1 of casting chamber cavity 12 i.e. in a plane parallel to Cartesian axis x-z. In a Cartesian co-ordinate system in which the x direction runs parallel to the longitudinal axis 1 and the second horizontal axis is known as the z axis, the inlet opening 35 shown in FIG. 3 has in the x direction a secondary axis of length 2 b and in the z direction a main axis of length 2 a.

Figure 4:
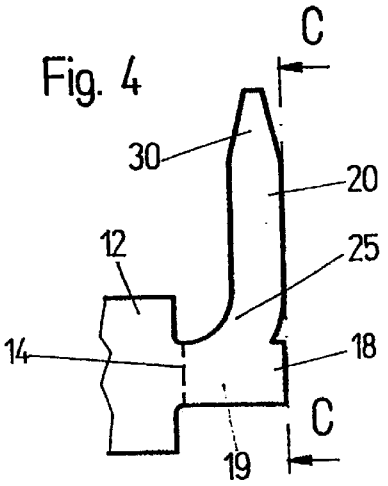
FIG. 4 shows diagrammatically a partial view of a longitudinal section running vertically through the concentric longitudinal axis of the casting chamber cavity of a further diecasting machine according to the invention with a single sprue.

FIG. 4 shows a partial view of a longitudinal section of a further diecasting machine according to the invention, running vertically through the concentric longitudinal axis 1 of the sprue cavity 12, where in this longitudinal section can be seen part of the horizontal casting chamber 10 with casting chamber cavity 12 and sprue system 17. The sprue system 17 contains a sprue cavity 19 and a single sprue 20.

The transition from the sprue cavity 12 to the passage opening 14 is rounded. The sprue cavity 19 adjacent to the passage opening 14 is circular cylindrical in shape where the cross sectional diameter of the sprue cavity 19 corresponds to the diameter of the passage opening 14, and the longitudinal axis of sprue cavity 19 coincides with longitudinal axis 1 of the casting chamber cavity 12. A manifold 25 of a single sprue 20 leads laterally upwards away from the generated surface of the sprue cavity 19. Next to the manifold chamber 25, the sprue 20 has a straight channel section leading vertically upwards, to which is connected a chamfer area 30. In the view shown in FIG. 4, the chamfer area 30 tapers conically upwards and ends in the inlet opening 35. The cross sectional surface of the sprue 20 over its entire length, i.e. between the sprue cavity 19 and the inlet opening 35, substantially corresponds to the cross sectional area of the passage opening 14. The length of the sprue cavity 19 is such that a catchment pocket 18 is created to hold the surface oxide of the thixotropic alloy paste. In the embodiment shown here, the length of the sprue cavity 19 corresponds to the distance of the passage opening 14 from a tangential plane standing normal to longitudinal axis 1 and lying at the straight section of sprue 20 on the side remote from the casting chamber cavity 12.

Figure 5:
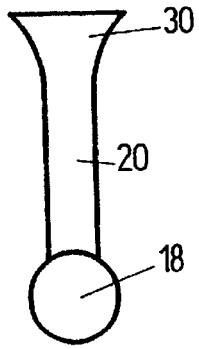
FIG. 5 shows a top view along line C—C of the diecasting machine shown in longitudinal section in FIG. 4.

FIG. 5 shows a top view along line C—C of the diecasting machine shown in longitudinal section in FIG. 4. Here, in addition to the catchment pocket 18, seen circular in this top view, is shown the sprue 20 with its chamfer area 30. The sprue leads vertically upwards. The chamfer area 30 in this top view concerns a continuously expanding area of the sprue 20 where the shape of the chamfer area 30 is selected such that in interaction with the view shown in FIG. 4, the cross sectional surface of the chamfer area 30 remains constant over its entire length.

Figure 6:
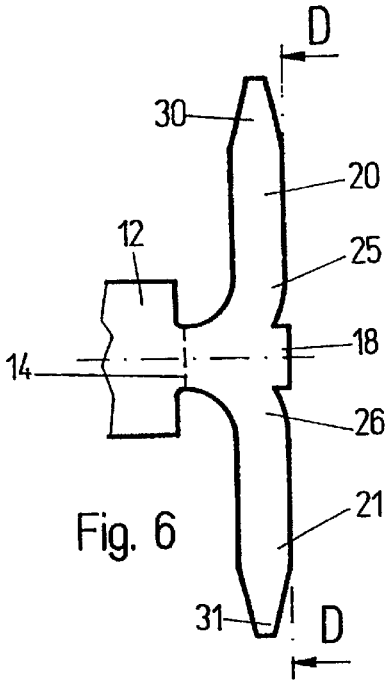
FIG. 6 shows diagrammatically a partial view of a longitudinal section running vertically through the concentric longitudinal axis of the casting chamber cavity of a further diecasting machine according to the invention with four sprues.

FIG. 6 shows diagrammatically a partial view of a longitudinal section running vertically through the concentric longitudinal axis 1 of the casting chamber cavity 12 of a further diecasting machine according to the invention. The transition from the casting chamber cavity 12 to the passage opening 14 is rounded. Next to the passage opening 14 is a circular cylindrical sprue cavity 19, the cross sectional diameter of which corresponds to the diameter of the passage opening 14, and the longitudinal axis of which coincides with the longitudinal axis 1 of the casting chamber cavity 12. Four manifolds 25, 26, 27, 28 lead away from the generated surface of the sprue cavity 19, where in FIG. 6 i.e. in a vertical plane along longitudinal axis 1 only two manifolds can be seen, namely manifold 25 of a sprue 20 leading vertically upwards and manifold 26 of a sprue 21 leading vertically downwards. To the manifolds 25, 26 are connected straight channel sections leading vertically upwards and downwards respectively of sprues 20, 21 with circular cross section. The chamfer areas 30, 31 connected to these straight channel sections have in the view shown in FIG. 6 a conically tapering cross section. Between the manifolds 25, 26 is enclosed a protuberance of the sprue cavity 19, the so-called catchment pocket 18.

Figure 7:
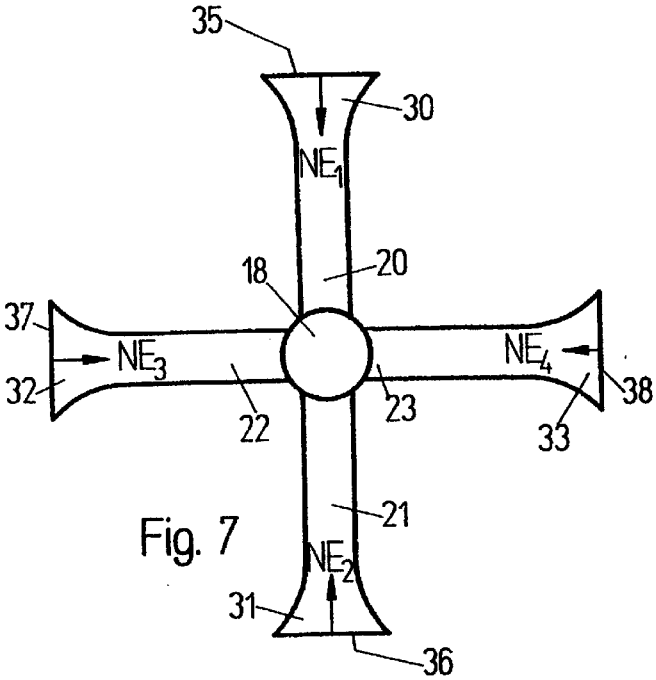
FIG. 7 shows a top view along line D—D onto the diecasting machine shown in longitudinal section in FIG. 6.

FIG. 7 shows a top view along line D—D of the diecasting machine shown in longitudinal section in FIG. 6. In this top view can be seen four sprues 20, 21, 22, 23 arranged in a cross shape. The concentric center lines (not shown) of these sprues 20, 21, 22, 23 enclose a right angle in this top view. In the center of this top view is the circular catchment pocket 18. To the straight sections of sprues 20, 21, 22, 23, leading away in a cross-shape from the catchment pocket 18 in the center, are connected the corresponding chamfer areas 30, 31, 32, 33. These chamfer areas 30, 31, 32, 33 describe the transition area between the straight sections of sprues 20, 21, 22, 23 and the corresponding inlet openings 35, 36, 37, 38. The chamfer areas 30, 31, 32, 33 in this top view concern a continuously expanding area of sprues 20, 21, 22, 23, where the shape of the chamfer areas 30, 31, 32, 33 is selected such that in interaction with the view shown in FIG. 4, the cross sectional area of each chamfer area 30, 31, 32, 33 remains constant over its entire length. All four sprues 20, 21, 22, 23 have the same form and same dimensions. Also the sprues 20, 21, 22, 23 are formed such that their cross sectional area remains constant over its entire length i.e. from the sprue cavity 19 to the corresponding inlet openings 20, 21, 22, 23. The surface normals $NE_1$, $NE_2$, $NE_3$, $NE_4$ on the inlet openings 35, 36, 37, 38 lie parallel to the center lines of the straight sections of the corresponding sprues 20, 21, 22, 23. Adjacent surface normals $NE_1$, $NE_2$, $NE_3$, $NE_4$ enclose a right angle between them.

Figure 8:
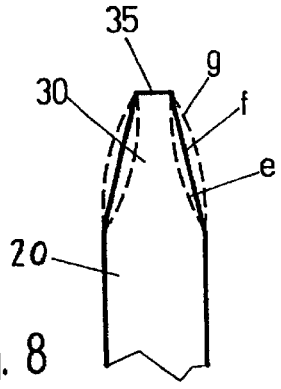
FIG. 8 shows various embodiments of a section of the upper sprue shown in FIG. 1, where this section in particular shows the chamfer area of the upper sprue and FIG. 8 various embodiments of this chamfer area in a longitudinal section running vertically through the concentric longitudinal axis of the casting chamber cavity.

FIG. 8 shows various embodiments of an extract of the upper sprue 20 shown in FIG. 1, where this section in particular concerns the chamfer area 30. Consequently, FIG. 8 shows various embodiments of the chamfer area 30 in a longitudinal section running vertically through the concentric longitudinal axis 1 of the casting chamber cavity 12. Here, the inlet opening 35 remains unchanged for all embodiments of the chamfer area 30. It is essential for the embodiments of the chamfer area 30 shown with the chamfer walls e, f, g that the chamfer area 30, as a transitional area between the straight channel section of the sprue 20 and the inlet opening 35, has the same cross sectional area throughout over its entire length and for all embodiments of the chamfer walls e, f, g. In the longitudinal section according to FIG. 8 the chamfer wall f (solid line) has the shape of a trapezium with equal sides and corresponds to the view of the chamfer area 30 shown in FIG. 1. The chamfer wall e has a form curving continuously inward, and the chamfer wall g a form curving continuously outward.

Figure 9:
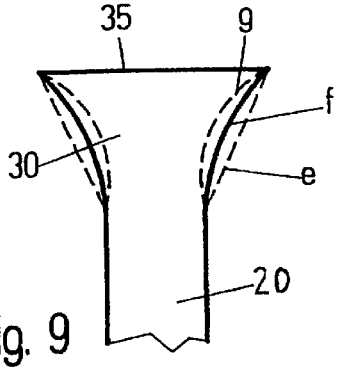
FIG. 9 shows the top view along line A—A of the embodiment shown in longitudinal section in FIG. 8 of the chamfer area in FIG. 1.

FIG. 9 shows the top view along line A—A of the embodiments of the chamfer area 30 of FIG. 1 shown in longitudinal section in FIG. 8. The inlet opening 35 again remains unchanged for all embodiments of the chamfer area 30. To fulfil the requirement for a cross sectional area along the chamfer area 30, where this requirement applies for all embodiments of the chamfer area 30, the chamfer walls e, f, g in the top view according to FIG. 9 must have a greater cross section, the smaller their cross section in the longitudinal section in FIG. 8. Consequently, the chamfer wall e in FIG. 9 has a trapezoid shape whereas the chamfer wall f compared with the chamfer wall e is curved continuously inwards and the chamfer wall f compared with the chamfer wall e in the top view shown in FIG. 9 overall has a smaller cross section. The chamfer wall g in comparison with the chamfer wall f has a stronger inward curvature so that its cross section in the top view shown in FIG. 9 overall is smaller than the chamfer wall f.

What is claimed is:

1. Diecasting machine for production of mouldings from thixotropic metal billets, which comprises: a sprue system which connects a cylindrical casting chamber cavity with a moulding cavity, where the sprue system has a cylindrical sprue cavity immediately adjacent to the casting chamber cavity and contains at least one sprue, and said at least one sprue leads laterally away from a generated surface of the sprue cavity and wherein each sprue has a concentric center line and at its end facing towards the moulding cavity has an inlet opening for introduction of the thixotropic metal alloy into the moulding cavity; wherein the sprue system is connected to the casting chamber cavity by a passage opening having a surface normal and perpendicular in relation to a concentric longitudinal axis of the cylindrical casting chamber cavity, and the inlet openings are arranged in relation to the passage opening such that surface normals of the inlet openings do not coincide with the longitudinal axis of the cylindrical casting chamber cavity; and wherein each sprue has a circular or elliptical cross section with a substantially constant cross sectional area over its entire length, and immediately next to the sprue cavity has a manifold, where a part of the sprue between the manifold and the inlet opening describes a straight tubular channel section and the manifold is formed such that its center line has a constant bending radius continued to the passage opening and a tangent to the center line at the passage opening runs parallel to the longitudinal axis of the cylindrical casting chamber cavity, and a tangent to the center line at the end of the manifold facing towards the inlet opening coincides with the center line of the straight tubular channel section.

2. Diecasting machine according to claim 1, wherein at least one sprue at its end facing towards the moulding cavity has a chamfer area which ends in the corresponding inlet opening and the sprue between the sprue cavity and chamfer area is described by a tubular channel section with a circular cross section and constant diameter.

3. Diecasting machine according to claim 2, wherein the chamfer area describes a channel section which on the side next to the straight tubular channel section of the at least one sprue has a circular cross section, and the cross section of the chamfer area starting from this circular cross section transforms continuously and constantly into a cross sectional form of the inlet opening of the corresponding sprue.

4. Diecasting machine according to claim 3, wherein a cross sectional area of the chamfer area of a sprue remains substantially constant along its center line and nowhere varies by more than ±30% of the cross section of the straight tubular channel section next to the chamfer area of the corresponding sprue.

5. Diecasting machine according to claim 1, wherein a surface normal the inlet opening of at least one sprue is arranged perpendicular to the center line of the straight tubular channel section of the corresponding sprue.

6. Diecasting machine according to claim 1, wherein the center lines of the straight tubular channel section of the sprues enclose a right angle with the longitudinal axis of the casting chamber cavity.

7. Diecasting machine according to claim 6, wherein the bending radius of the center lines in the manifold of a sprue corresponds to a distance of the passage opening from a straight line containing the center line of the straight tubular channel section of the corresponding sprue.

8. Diecasting machine according to claim 1, wherein the longitudinal axis of the casting chamber cavity lies horizontal.

9. Diecasting machine according to claim 1, wherein between the casting chamber cavity and the passage opening is arranged a transition area with a constantly tapering cross section starting from the casting chamber cavity.

10. Diecasting machine according to claim 1, wherein a sum of the cross sectional areas of the individual sprues substantially corresponds to a cross sectional area of the passage opening.

11. Diecasting machine according to claim 10, wherein the sum of the cross sectional areas of the individual sprues lying at the sprue cavity deviates by no more than 10% from the cross sectional area of the passage opening.

12. Diecasting machine according to claim 1, wherein a longitudinal axis of the cylindrical sprue cavity runs parallel to the longitudinal axis of the casting chamber cavity, and the cross sectional area of the sprue cavity substantially corresponds to the cross sectional area of the passage opening.

13. Diecasting machine according to claim 1, wherein the length of the sprue cavity is selected such that between the manifolds is formed a catchment pocket for holding the surface oxide of the thixotropic metal billet.

14. Diecasting machine according to claim 1, wherein the inlet openings have an elliptical cross section.

* * * * *